United States Patent [19]

Weder et al.

[11] Patent Number: 4,496,614

[45] Date of Patent: Jan. 29, 1985

[54] COMPOSITION FOR DECORATIVE GRASS

[75] Inventors: Erwin H. Weder; Donald E. Weder; Herbert A. Weder, all of Highland, Ill.

[73] Assignee: Highland Manufacturing & Sales Company, Highland, Ill.

[21] Appl. No.: 506,902

[22] Filed: Jun. 23, 1983

Related U.S. Application Data

[62] Division of Ser. No. 247,108, Mar. 24, 1981, Pat. No. 4,401,700.

[51] Int. Cl.[3] ..... A41G 1/00

[52] U.S. Cl. ..... 428/7; 206/814; 428/17; 428/394; 524/313; 524/394

[58] Field of Search ..... 428/17, 394, 7, 222; 524/313, 394; 206/584, 814

[56] References Cited

U.S. PATENT DOCUMENTS

| | | | |
|---|---|---|---|
| 3,148,125 | 9/1964 | Strianse et al. | 424/64 |
| 3,673,056 | 6/1972 | Nadler | 428/17 |
| 3,933,959 | 1/1976 | Skochdopole et al. | 264/151 X |
| 3,937,811 | 2/1976 | Papantonlov et al. | 424/64 |
| 4,102,848 | 7/1978 | Koch et al. | 428/35 X |
| 4,199,627 | 4/1980 | Weder et al. | 428/17 X |
| 4,401,700 | 8/1983 | Weder et al. | 428/394 X |

*Primary Examiner*—Henry F. Epstein

*Attorney, Agent, or Firm*—Silverman, Cass & Singer, Ltd.

[57] ABSTRACT

The incorporation of organic and FD&C pigments that meet FDA specifications for food packaging materials into resinous articles is accomplished by dispersing the pigments into a non-toxic mineral or vegetable oil formulation which contains glycerol monooleate and zinc stearate, the formulation then being added to the resin and mixed. Resinous articles colored in this manner can be utilized safely as direct food contact packaging, for example, decorative grass, which enables candies to be placed directly on the grass without incurring the expense of overwrapping the candies with a resin film which meets FDA and USDA requirements and which eliminates the hazard involved when candies are inadvertently or unknowningly placed on the decorative grass. The resinous materials which may be colored by the organic and FD&C pigments include polyolefin resins.

2 Claims, No Drawings

COMPOSITION FOR DECORATIVE GRASS

This is a division of application Ser. No. 247,108, filed Mar. 24, 1981, now U.S. Pat. No. 4,401,700.

BACKGROUND OF THE INVENTION

This invention relates to colored resinous articles which meet Federal requirements for direct contact with food, and more particularly to a decorative grass which enables candies to be placed directly thereon without the need of separate overwrapping.

More specifically, the invention relates to pigmented color formulations which can be mixed with resinous products to provide uniform coloration thereof and produce a colored resinous product which can be utilized safely as a direct contact food packaging material.

Many resins are coming into widespread use for food packaging. Polyolefins such as polyethylene have been used extensively as the use of these resins have considerable economy, increased transparency, ease of handling economics such as lower shipping cost and less breakage and product protection in that they act as a very effective barrier to oxygen and thus assist in preservation of the food content. Polyolefin resins have also been used as a decorative packaging material for food products, such as the decorative grass disclosed in our U.S. Pat. No. 4,199,627. However, while resin packaging has proven to be economical and efficient in preserving food, and in the case of the decorative grass disclosed in our patent, capable of being manufactured into an improved product, there are no acceptable colorants which are approved for use in direct contact food packaging and at the same time compatible with the principal resins formed into the packaging materials. For instance, when polyolefins formed into decorative grasses are colored with conventional colorants and utilized for the purpose of holding a variety of candies, the candies must be separately wrapped to prevent direct contact of the food with the colored resinous material. The separate overwrapping adds significantly to the total cost of the finished package or product and, therefore, it would be of great economical advantage as well as a significant safety feature to color a resin packaging material with a colorant formulation which meets Federal requirements for direct food contact packaging.

The incorporation of dyes into resin base materials used for cosmetics are, of course, well-known to those in the art as exemplified by U.S. Pat. Nos. 3,148,125, issued Sept. 8, 1964, and 3,937,811, issued Feb. 10, 1976. U.S. Pat. No. 3,677,691, issued July 18, 1972, discloses a process for the conversion of water soluble dyestuffs which are approved for use in cosmetics, pharmaceuticals and food products into lypophilic colors which are readily dissolved in various oils. This patent was concerned with the fact that available oil soluble color compositions which were approved by the Food and Drug Administration were being drastically reduced in number, and that it became important for manufacturers of dyes and color additives to investigate the possibility of conversion of generally established non-toxic water soluble, oil insoluble dyes and pigments to a lypophilic state. U.S. Pat. No. 4,102,848, issued July 25, 1978, to Koch et al. is directed to coloring resin packaging materials and was concerned that at the time of the patent, there were no acceptable organic dyestuffs which were approved for use in contact with foods and beverages, medicinal products or cosmetics and at the same time compatible with many of the principal resins used for packaging. Accordingly, an object of the patent is to overcome disadvantages in the art of coloring plastic food, drug and cosmetic containers and to present to the art a resinous molding composition which is not only acceptable as safe for contact with consummable items but which resin is also colored in various shades and transparent to any degree desired. The patent accomplishes the object by first complexing the water soluble, resin insoluble FD&C dyestuffs with a polyhydric alcohol and subsequently the higher fatty acid ester decaglycerol tetraoleate in the presence of heat whereby it is possible to prepare a uniformly colored resin solution or paste which can be further cured to form a color tinted transparent plastic film or sheet useful in packaging. Briefly, U.S. Pat. No. 4,102,848 has succeeded to dissolve dyes into a substance, and incorporate that substance into a resinous material in which the dyes are usually not soluble.

While the Koch et al. invention may be successful, it would be advantageous to color resinous articles with pigment dispersions rather than the dye formulations disclosed in this patent. Pigment dispersions because of their insolubility, tend to migrate and bleed less than most dye formulations, such that color transfer onto other surfaces is substantially eliminated. Pigment dispersions typically do not fade as much as dye colorants when exposed to light over substantial periods of time. Further, pigment dispersions are more stable at higher temperatures in which most plastic extruding or molding devices operate, making processing of the resinous articles more feasible and economical. While dye formulations provide colored resinous articles of good transparency, pigment dispersions which are finely ground can often approach the transparency of dyed formulations.

Attempts have been made to disperse organic pigments that meet FDA specifications for food packaging materials and FD&C pigments into non-toxic oil such as mineral oil, but such attempts have been very difficult. Substances such as dipropylene glycol or dioctyl phthalate are very good dispersers, of pigments, but they are not very suitable in food packaging because of possible toxicity problems. On the other hand, the non-toxic oils such as mineral oil and some of the vegetable oils do not disperse pigments very well, resulting in that the pigments could not be broken down into small particles and form a uniform dispersion. When incorporated into resinous articles, the large particles of pigment tended to settle out, resulting in plastics colored from this type of formulation exhibiting poor strength of color, an uneven gritty consistency, and very poor transparency.

It is an object of the present invention to provide not only a resinous article which is acceptable as safe for direct contact with food stuffs, but which resin is also colored in various shades and transparencies to any degree desired.

It is a further object of the invention to provide a decorative grass packaging material which meets Federal requirements for direct food contact packaging, thereby eliminating the expense of overwrapping the food before contact with the packaging material and eliminates the hazard involved when unwrapped food is inadvertently or unknowingly placed on the decorative resin grass.

It is still another object of the invention to provide color formulation in which finely ground pigment is dispersed into non-toxic substances which are normally very poor dispersing agents, but which are compatible with resinous materials.

These and several other objects of the invention will become clear upon further consideration of the description of the invention set forth in the following general description and several selected and preferred modes of its practice.

BRIEF DESCRIPTION OF THE INVENTION

Accordingly, the present invention involves the finding that it is possible to disperse organic and FD&C pigments which meet FDA and USDA specifications for food packaging materials into non-toxic oil such as mineral and vegetable oils. By incorporating pigmented formulations into the resinous materials for producing colored resin products, the disadvantages of dyed solutions such as bleeding colors, fading and insufficient stability at higher temperatures are overcome. The present invention as well overcomes the difficulty in forming uniform dispersions of pigments with non-toxic oils. Accordingly, it is now possible to manufacture a food packaging material which has been pigmented in a variation of one or a combination of red, yellow, orange, green, blue and other blended hues which have been approved and generally recognized as safe for use in direct contact with edible products by the Food and Drug Administration.

Briefly, it has been found that the problems associated with non-uniformly dispersed pigments in non-toxic oils, are eliminated by the addition of zinc stearate and glycerol monooleate, in the proper proportions to mineral and vegetable oils which were previously poor dispersers of pigments. These previously poor dispersers can now be modified and provide dispersing characteristics which are needed to provide resinous articles with uniform color. It was found that the addition of zinc stearate and glycerol monooleate greatly increased the amount of shear that was created when the oil and pigment mixture was put on a three roll mill or a high speed disperser-mixer. This increased shear makes it possible to grind the pigment particles down to a very small size and, thus, increase the quality of dispersion. In addition, the pigment dispersions have the consistency to hold the small pigment particles in a uniform and even dispersion, resulting that pastics colored with the dispersion of the present invention are evenly colored throughout, strong in color, and high in gloss and transparency. Also, the zinc stearate and glycerol monooleate act as antistatic agents which remove static electricity from the finished resin products.

The color formulations or dispersions can be incorporated into many resin systems in which the mineral or vegetable oils are compatible, including polyolefin thermoplastic resins such as polyethylene and polypropylene. The resins are colored by simply applying the liquid color dispersion directly into the resin as the resin enters the screw of an extruding device. As the screw turns and as the plastic resin in the screw is melted, the color formulation is dispersed evenly throughout the plastic. As the resin leaves the screw through the die lip of the extruding device, it is beautifully colored with a uniform appearance. The color formulations can be added to the resin in varying concentrations to achieve the desired depth of color. A decorative grass formed by the process set forth in our previously issued U.S. Pat. No. 4,199,627 having incorporated therein color dispersions formulated in accordance with the teachings of the present invention produce a product which meets the Federal requirements for direct food contact packaging, eliminating the need for overwrapping foods, such as candies, and eliminates the hazard involved when such food is placed directly on the decorative grass.

While the exact amounts of each component in the color formulations may vary, a broad range of each of the individual components is given below, but should not be interpreted as the only amounts of these components which are workable. All percentages are by weight.

| Ingredient | Weight Percent |
|---|---|
| Non-toxic oil | 55–75 |
| Metal stearate | 5–10 |
| Glycerol monooleate | 3–5 |
| Pigment | 15–30 |

The following examples are presented to illustrate the practice of some preferred modes of our invention and form the basis of a detailed description of the invention. Unless otherwise indicated, the amounts described are set forth in percent by weight of the ingredients employed.

EXAMPLE I

This example illustrates a yellow pigment dispersion formulated in accordance with the teachings of the present invention:

18% FD&C Yellow #5 (C.I. No. 19140)
6% Zinc Stearate (Grade A. U.S.P.)
73% Mineral Oil
3% Glycerol Monooleate (Food Grade)

All percentages are by weight of the color dispersion. The entire formulation is placed into a drum and mixed with a high speed disperser at 3200 RPM for one hour. Once formed, the yellow colorants can be pumped directly into the resin as its enters the screw of an extruding device. A preferred amount of colored dispersion added to the resin is one part of dispersion (by weight) to 56 parts of resin (by weight).

EXAMPLE II

To form an orchid color dispersion, the following ingredient were required:

5.9% Ethyl Alcohol
7.5% Zinc Stearate
4% Glycerol Monooleate
67.3% Mineral Oil
8.5% Quinacridone Red (C.I. Pigment violet 19, C.I. No. 46500).
6.8% Phthalocyanine Blue (C.I. Pigment blue 15, C.I. No. 74160)

The ethyl alcohol, glycerol monooleate, and the phthalocyanine blue ingredients were placed into a drum. Next, 24% of the required amount of zinc stearate, and 15% of the required amount of mineral oil were added to the drum. The drum was placed under a high speed disperser and mixed at 3200 RPM for 15 minutes. The balance of the remaining ingredients were added to the drum and mixed for an additional half hour.

EXAMPLE III

A pink formulation was prepared as follows:

17% Quinacridone Red (Pigment violet 19, C.I. No. 46500)

6.1% Zinc Stearate 73.9% Mineral Oil

3% Glycerol Monooleate

All of the ingredients were added to a drum and the drum placed under a high speed disperser and mixed at 3200 RPM for one hour.

EXAMPLE IV

A green color formulation was prepared as follows:

16% Phthalocyanine Green (Pigment Green 7, C.I. No. 742600)

9% FD&C Yellow #5 (C.I. No. 19140)

3.9% Glycerol Monooleate 5.2% Zinc Stearate 65.9% Mineral Oil

All of the ingredients of the formulation, except the mineral oil, were placed into a drum. Next, 51% of the required amount of mineral oil was added and the drum placed under a high speed disperser and mixed at 3200 RPM for one hour. The dispersion was removed from the disperser and the material run through a three roll mill set at 150 to 170 pounds of pressure and run for about 24 hours. After completion of the milling, the balance of the mineral oil was added and the color dispersion placed on the high speed disperser and mixed at 1000 RPM for 20 minutes.

EXAMPLE V

The following ingredients were used to form a green pigment dispersion:

10.8% Ethyl Alcohol 4.9% Zinc Stearate 4.5% Glycerol Monooleate 56.8% Mineral Oil 14% Hisperse Phthalocyanine Green (Pigment Green 7, C.I. No. 74260)

9% FD&C Yellow #5 (C.I. No. 19140)

All of the ingredients of the formula, except for the FD&C yellow were placed into a drum and the drum placed under a high speed disperser and mixed at 3200 RPM for 15 minutes. Next, the FD&C yellow required was placed in the disperser and mixed for one hour.

The foregoing is considered as illustrative only of the principles of the invention. Further, since numerous modifications and changes will readily occur to those skilled in the art, it is not desired to limit the invention to the exact formulations described, and accordingly, all suitable modifications and equivalents may be resorted to, falling within the scope of the invention.

What is claimed as new is as follows:

1. A colored, non-toxic, resinous packaging material for direct food contact packaging which comprises a major amount of resin and a minor amount of a color formulation dispersed throughout said resin, said formulation comprising a pigment insoluble in said resin and selected from the group consisting of organic pigments and FD&C pigments, said formulation further comprising a metal stearate, a non-toxic oil and glycerol monooleate.

2. The colored resinous packaging material of claim 1 wherein said metal stearate is zinc stearate and said non-toxic oil is mineral oil.

* * * * *